US010494933B2

(12) United States Patent
Bryant, Jr. et al.

(10) Patent No.: US 10,494,933 B2
(45) Date of Patent: Dec. 3, 2019

(54) AIRFOIL WITH MULTI-MATERIAL REINFORCEMENT

(71) Applicant: General Electric Company, Schenectady, NY (US)

(72) Inventors: Gary Willard Bryant, Jr., Loveland, OH (US); Tod Winton Davis, Liberty Township, OH (US); Wei Wu, Mason, OH (US)

(73) Assignee: General Electric Company, Schenectady, NY (US)

( * ) Notice: Subject to any disclaimer, the term of this patent is extended or adjusted under 35 U.S.C. 154(b) by 344 days.

(21) Appl. No.: 15/074,180

(22) Filed: Mar. 18, 2016

(65) Prior Publication Data

US 2017/0268349 A1 Sep. 21, 2017

(51) Int. Cl.

| | |
|---|---|
| ***F01D 5/28*** | (2006.01) |
| ***F01D 5/14*** | (2006.01) |
| ***F04D 29/32*** | (2006.01) |

(52) U.S. Cl.

CPC ..... *F01D 5/282* (2013.01); *F01D 5/147* (2013.01); *F04D 29/324* (2013.01); *F05D 2220/36* (2013.01); *F05D 2240/303* (2013.01); *F05D 2240/304* (2013.01); *F05D 2240/307* (2013.01); *F05D 2300/603* (2013.01)

(58) Field of Classification Search

CPC . F01D 5/147; F01D 5/28; F01D 5/282; F01D 5/284; F01D 5/286; F01D 5/288; F04D 29/324; F05D 2300/603; B64C 11/20; B64C 11/205; B64C 2027/4733; B64C 2027/4736

See application file for complete search history.

(56) References Cited

U.S. PATENT DOCUMENTS

| | | | | |
|---|---|---|---|---|
| 4,810,167 | A * | 3/1989 | Spoltman | B29D 99/0025 416/229 A |
| 7,575,417 | B2 | 8/2009 | Finn et al. | |
| 7,740,932 | B2 | 6/2010 | Kismarton | |
| 8,419,363 | B2 | 4/2013 | Madsen et al. | |
| 8,622,709 | B2 | 1/2014 | Kuroiwa | |
| 2005/0053466 | A1 * | 3/2005 | Finn | F01D 5/147 416/230 |
| 2011/0038732 | A1 | 2/2011 | Huth et al. | |
| 2012/0021243 | A1 * | 1/2012 | Kray | B23P 15/04 428/602 |
| 2013/0164140 | A1 | 6/2013 | Shah et al. | |

FOREIGN PATENT DOCUMENTS

WO 2014/031203 A2 2/2014

OTHER PUBLICATIONS

Extended European Search Report and Opinion issued in connection with corresponding EP Application No. 17160480.4 dated Aug. 29, 2017.

* cited by examiner

*Primary Examiner* — Jason D Shanske
*Assistant Examiner* — Julian B Getachew
(74) *Attorney, Agent, or Firm* — General Electric; Kristi Davidson

(57) ABSTRACT

An airfoil includes: an airfoil body having convex and concave sides extending between a leading edge and a trailing edge, the airfoil body including primary and secondary regions having differing physical properties; and at least one metallic cladding element attached to the airfoil body.

24 Claims, 3 Drawing Sheets

AIRFOIL WITH MULTI-MATERIAL REINFORCEMENT

BACKGROUND OF THE INVENTION

This invention relates generally to airfoils and in particular to fan blades with multi-material reinforcement.

Fan blades and other structures used in turbine engine applications are susceptible to foreign object impact damage, for example during bird ingestion events ("bird strikes"). Blades made of composite materials such as carbon fiber reinforced epoxy are attractive due to their high overall specific strength, specific stiffness and light weight. However, carbon composites are particularly prone to brittle fracture and delamination during foreign object impacts due to their low ductility. Blade leading edges, trailing edges, and tips are particularly sensitive because of the generally lower thickness in these areas and the well-known susceptibility of laminated composites to free edge delamination.

For best aerodynamic performance, it is desirable to use fan blades which are thin and have a long chord. One problem with such fan blades is that higher strains are encountered in the event of a bird strike as compared to thicker blades having a shorter chord.

It is known to provide impact damage protection for composite fan blades using metallic guards bonded thereto, also referred to as metallic cladding. For example, fan blades are known as having a composite body with metallic cladding extending over the leading edge, the tip, and the trailing edge.

Metallic cladding is generally made of high-density alloys. One problem with their use over extensive areas of an airfoil is that their weight offsets the weight savings from the use of composite material.

BRIEF SUMMARY OF THE INVENTION

At least one of the above-noted problems is addressed by an airfoil made of composite material incorporating regions with material having increased elongation properties, in combination with metallic cladding.

According to one aspect of the technology described herein, an airfoil includes: an airfoil body having convex and concave sides extending between a leading edge and a trailing edge, the airfoil body including primary and secondary regions having differing physical properties; and at least one metallic cladding element attached to the airfoil body.

According to another aspect of the technology described herein, an airfoil includes: an airfoil body having a root and a tip, and convex and concave sides extending between a leading edge and a trailing edge, the airfoil body including primary and secondary regions having differing material properties; and at least one metallic cladding element attached to the airfoil body; wherein within the primary region, the entire thickness of the airfoil body includes a first composite material comprising a polymeric matrix strengthened with carbon fibers; and wherein the secondary region is disposed adjacent to at least one free edge of the airfoil body, and within the secondary region, an inner core of the airfoil body includes the first composite material, while an outer skin includes a second composite material includes a polymeric matrix strengthened with glass fibers.

According to another aspect of the technology described herein, an airfoil includes: an airfoil body having convex and concave sides extending between a leading edge and a trailing edge, the airfoil body including primary and secondary regions, wherein each of the primary and secondary regions includes a composite material including a matrix having reinforcing fibers embedded therein, the primary region having a first elongation, and the secondary region having a second elongation greater than the first elongation; and a first metallic cladding element attached to the body, the metallic cladding element covering a portion of the secondary region.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
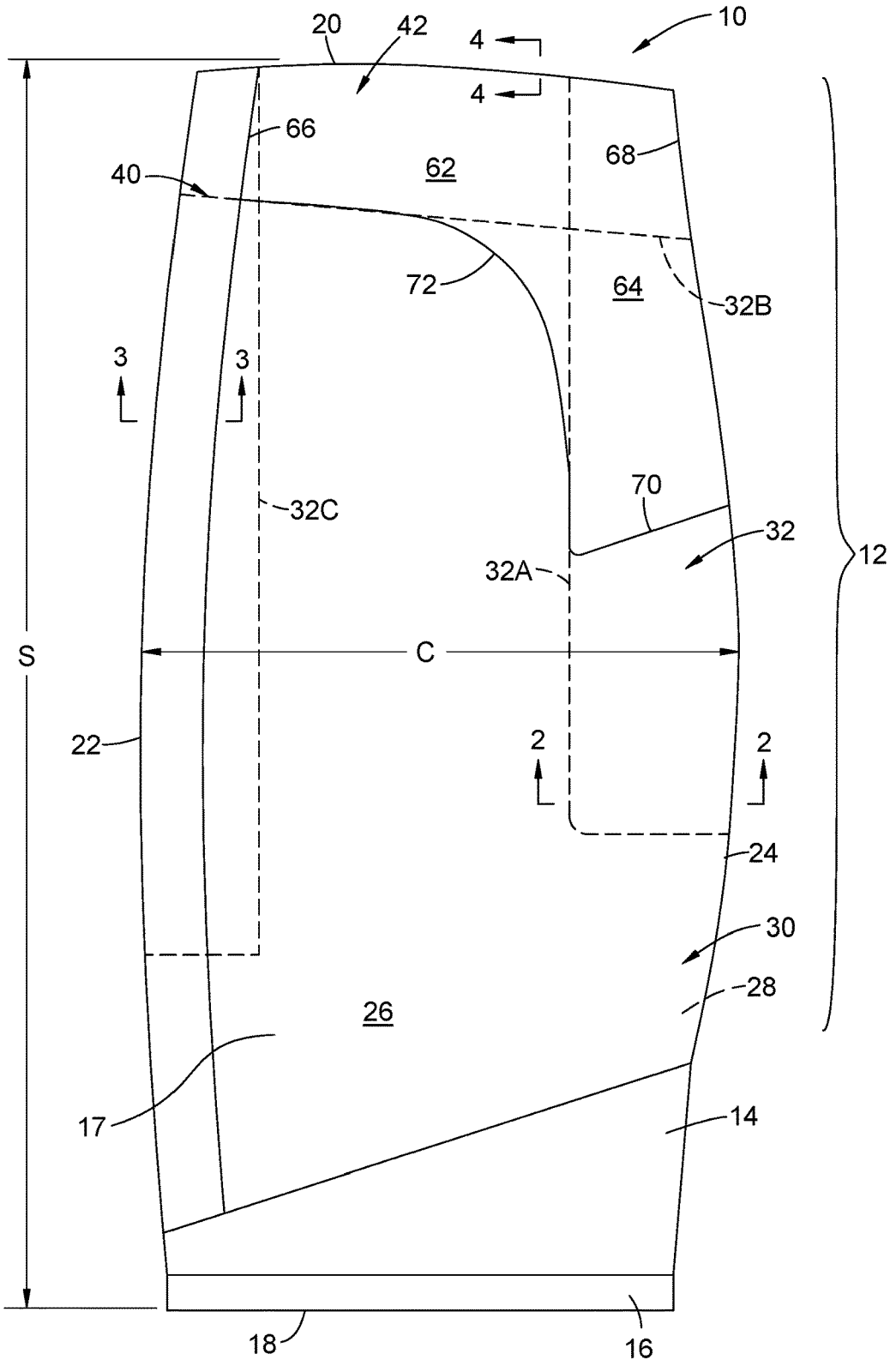
FIG. 1 is a side elevation view of an exemplary gas turbine engine fan blade.

Referring to the drawings wherein identical reference numerals denote the same elements throughout the various views, FIG. 1 depicts an exemplary fan blade 10 for a gas turbine engine. The fan blade 10 includes an airfoil 12, shank 14, and dovetail 16. A portion of the airfoil 12, along with the shank 14 and the dovetail 16, are part of a unitary airfoil body 17. The airfoil 12 extends between a root 18 and a tip 20, and has a leading edge 22 and a trailing edge 24. Opposed convex and concave sides 26 and 28, respectively, extend between the leading edge 22 and the trailing edge 24. The tip 20, the leading edge 22, and the trailing edge 24 can each be considered a "free edge" of the airfoil body 17. The fan blade 10 is merely an example; the principles of the present invention are applicable to other kinds of structures requiring impact protection.

The airfoil body 17 is made from a composite material, defined herein as a material including two or more distinct materials combined into one structure, for example a matrix having reinforcing fibers embedded therein. One example of a composite system suitable for use in aerospace applications includes an epoxy matrix with carbon fiber reinforcement.

More specifically, the airfoil body 17 incorporates two or more regions wherein each region comprises a unique composite system. A primary region 30 is made from a first composite system having a first set of physical properties that includes a first stiffness and a first elongation. "Elongation" as used herein refers to the increase in gage length of a material specimen before tensile failure. This increase may be expressed as a percentage of the original gage length. This usage is consistent with the commonly accepted definition of the term. In the illustrated example the primary region 30 comprises an epoxy matrix with carbon reinforcing fibers. In general the primary region 30 extends throughout the majority of the airfoil body 17.

The airfoil body 17 may incorporate one or more secondary regions. The secondary regions, designated 32 collectively, are made from a second composite system having a second set of physical properties that includes a second stiffness and a second elongation. More specifically, the second stiffness is less than the first stiffness, and the second elongation is greater than the first elongation. Stated another way, each secondary region 32 is less stiff (and may be weaker in terms of yield stress and/or ultimate tensile stress) than the primary region 30, but allows more deflection or strain to failure. In the illustrated example, some or all of each secondary region 32 comprise an epoxy matrix with reinforcing fibers having greater elongation than carbon fibers, referred to generally herein as "high-elongation" fibers. One non-limiting example of a high-elongation fiber is glass fiber. For example, glass fibers commercially available as "E-glass" or "S-glass" may be used for this purpose. In general each secondary region 32 extends over a relatively small portion of the airfoil body 17, preferably a portion that is subject to high strains during an impact.

In the illustrated example, three different potential secondary regions 32A, 32B, and 32C are shown. The boundaries of these potential secondary regions 32A, 32B, and 32C are delineated by dashed lines. Each secondary region 32A, 32B, and 32C is disposed adjacent to one or more of the free edges of the airfoil body 17, including the tip 20, the leading edge 22, and the trailing edge 24. A first example secondary region is labeled 32A. In the radial direction, the secondary region 32A begins at a location approximately ¼ of the span "S" of the fan blade 10 away from the root 18, and extends to the tip 20 of the fan blade 10. In the chordwise direction, the secondary region 32A extends from the trailing edge 24 forward, from the leading edge 22 aftward, covering approximately ⅓ of the chord dimension "C" of the fan blade 10. These dimensions can be varied to suit a particular application.

A second example secondary region is labeled 32B and is positioned adjacent to the tip 20. From the tip 20, the second secondary region 32B extends radially to cover ¼ of the span S and covers the entire chord dimension C.

A third example secondary region is labeled 32C and is positioned adjacent to the leading edge 22. In the radial direction, the secondary region 32C begins at a location approximately ¼ of the span S away from the root 18, and extends to the tip 20. In the chordwise direction, the secondary region 32C extends from the leading edge 24 aftward, covering approximately ⅓ of the chord dimension C.

Any or all of the example secondary regions 32A, 32B, and 32C described above may be implemented individually or in combination. For example, a single, large secondary region designated 32 having an inverted "U" shape may be provided, representing the union of all three secondary regions 32A, 32B, and 32C.

As a general principle, it is desirable to limit the size of the secondary regions 32 because of their lower strength. Furthermore, as a general principle, it is desirable to locate the intersection of the primary region 30 and the secondary regions 32 in an area that is not subject to high stresses. Accordingly, the exact size and shape of the secondary regions 32 may be determined on a case-by-case basis.

Figure 2:
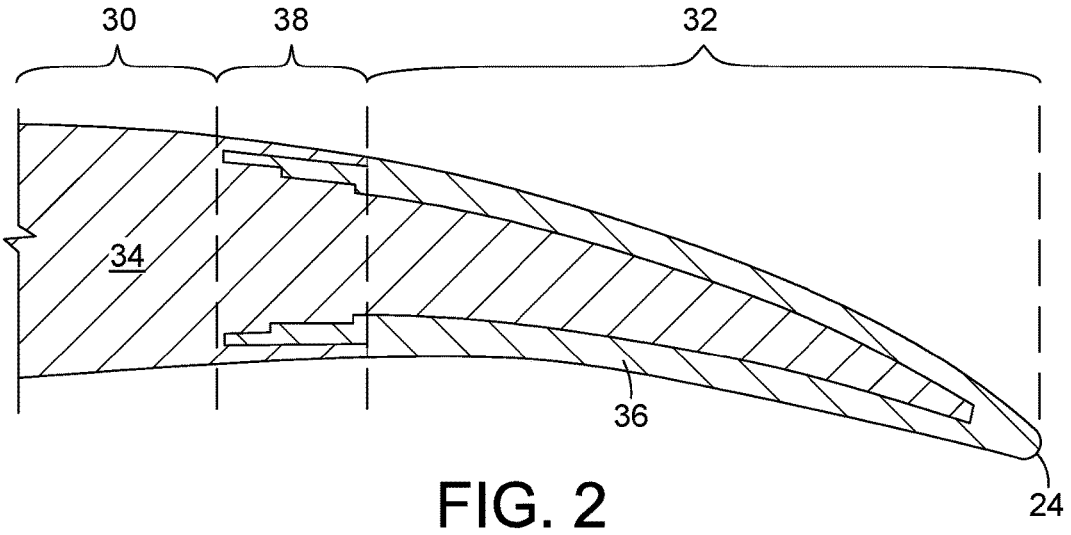
FIG. 2 is a cross-sectional view taken along lines 2-2 of FIG. 1.

FIG. 2 illustrates the construction of the primary and secondary regions 30, 32 in more detail. This view is representative of the construction of a single collective U-shaped secondary region 32, as well as any of the individual secondary regions 32A, 32B, or 32C described above. In the primary region 30, the entire thickness of the airfoil body 17 comprises a first composite material 34 such as an epoxy matrix strengthened with carbon fibers. In the secondary region 32, the inner core of the airfoil body 17 comprises the first composite material 34, while an outer skin comprises a second composite material 36 such as an epoxy matrix strengthened with high-elongation fibers, for example E-glass or S-glass fibers. The relative thickness of the different reinforcing fibers may be varied to suit a particular application. In the illustrated example, a small portion of the airfoil body 17 immediately adjacent to the free edge (trailing edge 24 shown) comprises an epoxy matrix with high-elongation fibers through its entire thickness.

A transition zone 38 may be provided between the first and secondary regions 30, 32 in order to avoid stress concentrations at the junctures between dissimilar materials. In the illustrated example, the thickness of the second composite material 36 is reduced in a staggered, "stair-stepped" configuration within the transition zone 38. Additionally, a layer of the first composite material 34 overlies the second composite material 36 within the transition zone 38 in order to create an interlocking joint. The exact transition of the staggered, "stair-stepped" pattern is determined on a case-by-case basis, given different coverage areas of first and second composite material.

The primary and secondary regions 30, 32 may be manufactured concurrently, for example by providing a layup of the desired configuration of reinforcing fibers, infiltrating the fiber layup with uncured resin, and then curing the resin.

In addition to the high-elongation fibers, the fan blade 10 also incorporates at least one metallic cladding element. In the specific example shown in FIG. 1, the cladding elements comprise a leading edge guard 40 and a tip cap 42.

The leading edge guard 40 is attached to the leading edge 22. The leading edge guard 40 provides the fan blade 10 with additional impact resistance, erosion resistance and improved resistance of the composite structure to delamination.

Figure 3:
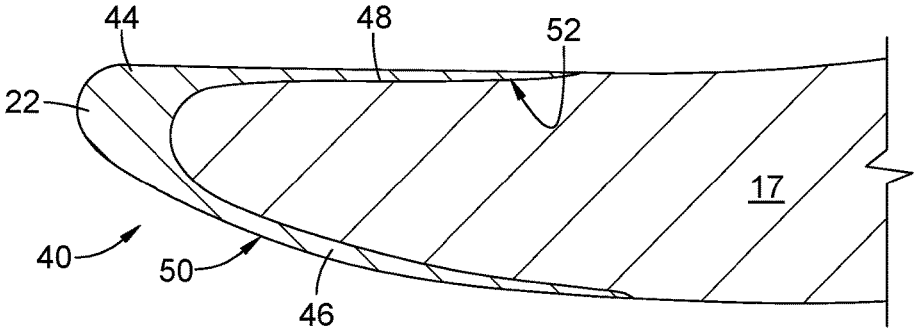
FIG. 3 is a cross-sectional view taken along lines 3-3 of FIG. 1.

As best seen in FIG. 3, the leading edge guard 40 comprises a nose 44 with a pair of wings 46 and 48 extending aft therefrom. The wings 46 and 48 taper in thickness as they extend away from the nose 44. Exterior surfaces of the nose 44 and wings 46 and 48 collectively define an exterior surface 50 of the leading edge guard 40. The shape and dimensions of the exterior surface 50 are selected to act as an aerodynamic extension of the airfoil body 17. Stated another way, the exterior shape of the airfoil 12 is defined in part by the airfoil body 17 and in part by the leading edge guard 40. The leading edge guard 40 may be attached to the airfoil body 17 with a known type of adhesive.

Interior surfaces of the nose 44 and wings 46 and 48 collectively define an interior surface 52 of the leading edge guard 40. The shape and dimensions of the interior surface 52 are selected to closely fit the exterior of the airfoil body 17.

The leading edge guard 40 may be made from a metal alloy of a composition providing desired strength and weight characteristics. Non-limiting examples of suitable alloys for construction of the leading edge guard 40 include titanium alloys and nickel alloys.

Figure 4:
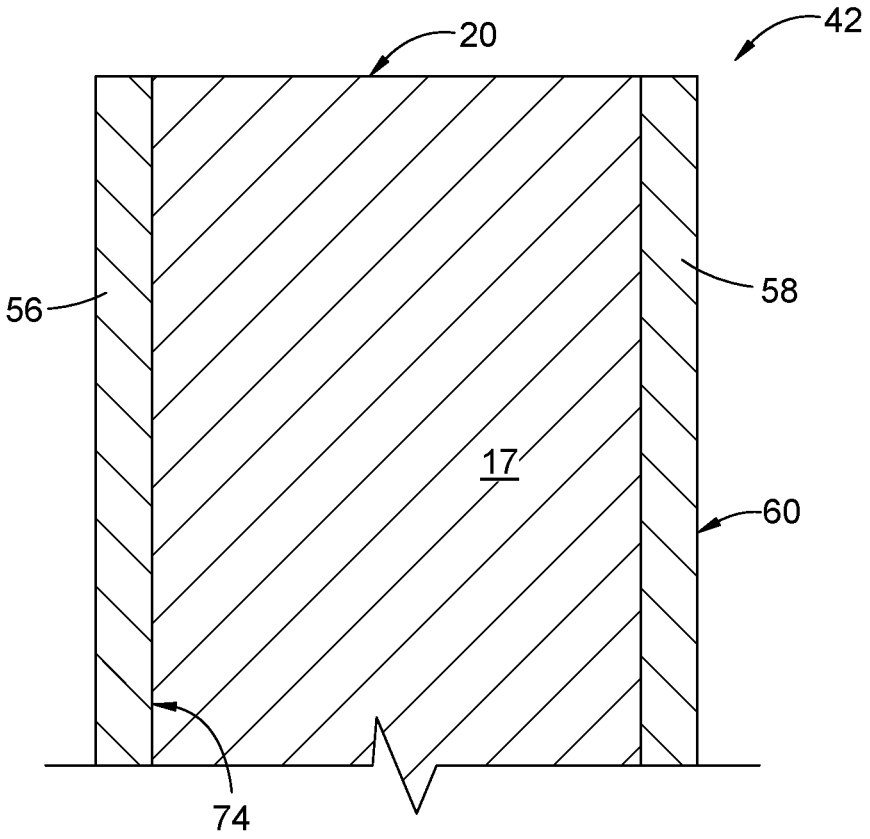
FIG. 4 is a cross-sectional view taken along lines 4-4 of FIG. 1.

The tip cap 42 overlies portions of the convex and concave sides 26, 28 adjacent to the tip 20. The tip cap 42 provides additional impact protection, as well as stiffens the airfoil body 17 in the free edge regions of the tip and trailing edge 24. As best seen in FIG. 4, the tip cap 42 includes a pair of side walls 56 and 58. The exterior surfaces of the side walls 56 and 58 collectively define an exterior surface 60 of the tip cap 42. The shape and dimensions of the exterior surface 60 are selected to act as an aerodynamic extension of the airfoil body 17. Stated another way, the exterior shape of the airfoil 12 is defined in part by the airfoil body 17 and in part by the tip cap 42. The tip cap 42 may be attached to the airfoil body 17 with a known type of adhesive.

As viewed in side elevation (FIG. 1), the tip cap 42 includes a tip portion 62 and a trailing edge portion 64. The two portions 62 and 64 roughly define an L-shape. An upper forward edge 66 of the tip cap 42 abuts the leading edge guard 40. An upper aft edge 68 of the tip cap 42 follows the trailing edge 24 of the airfoil body 17. A lower aft edge 70 of the tip 20 extends from the upper aft edge 68 axially forward and radially inward. A lower forward edge 72 of the tip cap 42 interconnects the lower aft edge 68 and the upper forward edge 66.

Interior surfaces of the side walls 56 and 58 collectively define an interior surface 74 of the tip cap 42 (see FIG. 4). The shape and dimensions of the interior surface 74 are selected to closely fit the exterior of the airfoil body 17.

In the radial direction, the trailing edge portion 64 begins at the tip 20 of the fan blade 10, and extends to a location approximately ½ of the span S of the fan blade 10 in the chordwise direction, the trailing edge portion 64 extends from the trailing edge 24 forward, covering approximately ⅓ of the chord C of the fan blade 10. The tip cap 42 may or may not overly a portion of the secondary region 32 as these dimensions can be varied to suit a particular application. As a general principle, it is desirable to limit the size of the tip cap 42 in order to minimize its weight.

The tip cap 42 may be made from a metal alloy of a composition providing desired strength and weight characteristics. Non-limiting examples of suitable alloys for construction of the tip cap 42 include titanium alloys and nickel alloys.

The fan blade 10 described above incorporates the beneficial properties of composite and metallic materials to maximize the impact capability and aerodynamic performance, while minimizing the overall weight of the blade.

The incorporation of high-elongation fibers in the composite body provides a higher strain to failure capability compared to the use of carbon fibers only. The use of the metallic tip cap reduces any additional deflection of the blade that may be caused by the relatively less stiff composite material. The incorporation of the high-elongation fibers permits the tip cap to be significantly smaller than would otherwise be required in a conventional composite airfoil using only carbon fiber. This will provide a weight savings with accompanying improvement in engine efficiency.

The foregoing has described an airfoil with multi-material reinforcement. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying potential points of novelty, abstract and drawings), or to any novel one, or any novel combination, of the steps of any method or process so disclosed.

What is claimed is:

1. An airfoil, comprising:

an airfoil body having a root, a tip, a convex side, and a concave side, the convex and concave sides extending between a leading edge of the airfoil body and a trailing edge of the airfoil body, the airfoil body comprising:

a primary region formed of a first composite material, the first composite material encompassing an entire thickness of the airfoil body from the convex side to the concave side;

a secondary region comprising an inner core and an outer skin of the airfoil body, the inner core being formed of the first composite material and the outer skin being formed of a second composite material having differing material properties from the first composite material, the first and second composite materials combining to encompass an entire thickness of a portion of the airfoil body from the convex side to the concave side; and a transition zone positioned between the primary region and the secondary region, wherein a portion of the outer skin extends into the transition zone such that in the transition zone, a layer of the first composite material overlies all of the second composite material extending into the transition zone to create an interlocking joint; and at least one metallic cladding element attached to the airfoil body.

2. The airfoil of claim 1 wherein each of the first and second composite materials includes a matrix having reinforcing fibers embedded therein.

3. The airfoil of claim 2 wherein at least one of the first and second composite materials is a polymeric matrix composite having carbon reinforcing fibers.

4. The airfoil of claim 3 wherein the second composite material is a polymeric matrix composite having high-elongation reinforcing fibers with an elongation greater than that of carbon fibers.

5. The airfoil of claim 4 wherein the high-elongation reinforcing fibers comprise glass fibers.

6. The airfoil of claim 1 wherein the secondary region is disposed adjacent to at least one free edge of the airfoil body.

7. The airfoil of claim 6 wherein the secondary region is disposed adjacent to the leading edge or trailing edge of the airfoil body, and covers one-third of a chord dimension of the airfoil.

8. The airfoil of claim 1 wherein the first composite material comprises a polymeric matrix strengthened with carbon fibers and the second composite material comprises a polymeric matrix strengthened with glass fibers.

9. The airfoil of claim 8 wherein a portion of the secondary region immediately adjacent to some or all of free edges of the airfoil body comprises the second composite material formed of a polymeric matrix with glass fibers through the entire thickness of the airfoil body from the convex side to the concave side.

10. The airfoil of claim 1 wherein one of the at least one metallic cladding elements is a leading edge guard attached to the leading edge of the airfoil body, the leading edge guard comprising a nose with spaced-apart first and second wings extending therefrom.

11. The airfoil of claim 1 wherein one of the at least one metallic cladding elements is a tip cap attached to the tip of the airfoil body, the tip cap comprising a pair of side walls extending along the convex and concave sides of the airfoil body.

12. The airfoil of claim 11 wherein an exterior surface of the tip cap acts as an aerodynamic extension of the airfoil body.

13. The airfoil of claim 11 wherein the tip cap is attached to the airfoil body with an adhesive.

14. The airfoil of claim 11 wherein the tip cap includes a tip portion and a trailing edge portion, the tip portion and trailing edge portion collectively defining an L-shape.

15. The airfoil of claim 11 wherein the tip cap extends from the tip of the airfoil body to a location one-half of a span of the airfoil.

16. The airfoil of claim 14 wherein in the chordwise direction, the trailing edge portion of the tip cap extends from the trailing edge forward, covering one-third of a chord dimension of the airfoil body.

17. An airfoil, comprising:

an airfoil body having a root, a tip, a convex side, and a concave side, the convex and concave sides extending between a leading edge of the airfoil body and a trailing edge of the airfoil body, the airfoil body comprising a primary region, a transition zone, and a secondary region, the primary region having differing material properties than the secondary region;

at least one metallic cladding element attached to the airfoil body;

wherein the primary region is formed of a first composite material comprising a polymeric matrix strengthened with carbon fibers, the first composite material encompassing an entire thickness of the airfoil body from the convex side to the concave side;

wherein the secondary region is disposed adjacent to at least one free edge of the airfoil body, the secondary region including an inner core and an outer skin of the airfoil body, the inner core being formed of the first composite material and the outer skin being formed of a second composite material comprising a polymeric matrix strengthened with glass fibers, the first and second composite materials combining to encompass an entire thickness of a portion of the airfoil body from the convex side to the concave side; and wherein the transition zone is positioned between the primary region and the secondary region, and wherein a portion of the outer skin extends into the transition zone such that in the transition zone, a layer of the first composite material overlies all of the outer skin extending into the transition zone to create an interlocking joint, the outer skin being reduced in thickness as the outer skin extends from the secondary region into the transition zone.

18. The airfoil of claim 17 wherein a portion of the secondary region immediately adjacent to one or more of the free edges of the airfoil body comprises the second composite material formed of a polymeric matrix with glass fibers through the entire thickness of the airfoil body from the convex side to the concave side.

19. The airfoil of claim 17 wherein one of the at least one metallic cladding elements is a tip cap attached to the tip of the airfoil body, the tip cap comprising a pair of side walls extending along the convex and concave sides of the airfoil body.

20. The airfoil of claim 19 wherein the tip cap includes a tip portion and a trailing edge portion, the tip portion and trailing edge portion collectively defining an L-shape.

21. An airfoil, comprising:

an airfoil body having convex and concave sides extending between a leading edge of the airfoil body and a trailing edge of the airfoil body, the airfoil body comprising:

a primary region formed of a first composite material comprising a matrix having reinforcing fibers embedded therein, the first composite material encompassing an entire thickness of the airfoil body from the convex side to the concave side;

a secondary region comprising an inner core and an outer skin of the airfoil body, the inner core being formed of the first composite material and the outer skin being formed of a second composite material having differing material properties from the first composite material and comprising a matrix having reinforcing fibers embedded therein, the first and second composite materials combining to encompass an entire thickness of a portion of the airfoil body from the convex side to the concave side;

a transition zone positioned between the primary region and the secondary region, wherein a portion of the outer skin extends into the transition zone such that in the transition zone, a layer of the first composite material overlies all of the second composite material extending into the transition zone to create an interlocking joint, the second composite material being reduced in thickness in a staggered configuration as the outer skin extends from the secondary region into the transition zone;

wherein the primary region has a first elongation and the secondary region has a second elongation greater than the first elongation; and a metallic cladding element attached to the airfoil body, the metallic cladding element covering a portion of the secondary region.

22. The airfoil of claim 21 wherein at least one of the first and second composite materials is a polymeric matrix including carbon reinforcing fibers.

23. The airfoil of claim 22 wherein the second composite material is a polymeric matrix including high-elongation reinforcing fibers having an elongation greater than that of carbon fibers.

24. The airfoil of claim 23 wherein the second composite material is a polymeric matrix including glass reinforcing fibers.

* * * * *